United States Patent [19]

Caudill

[11] 4,106,972

[45] Aug. 15, 1978

[54] VELOCITY COMPENSATOR AND APPARATUS INCORPORATING THE SAME

[75] Inventor: Donald L. Caudill, Riverside, Calif.

[73] Assignee: Label-Aire Inc., Fullerton, Calif.

[21] Appl. No.: 836,779

[22] Filed: Sep. 26, 1977

[51] Int. Cl.[2] ..... B65C 9/40

[52] U.S. Cl. ..... 156/363; 340/681

[58] Field of Search ..... 156/361-364; 83/76, 72; 226/2, 45; 118/4, 7, 8; 364/268

[56] References Cited

U.S. PATENT DOCUMENTS

| | | | |
|---|---|---|---|
| 3,907,626 | 9/1975 | Cook | 156/363 X |
| 4,013,037 | 3/1977 | Warning | 118/8 X |
| 4,042,011 | 5/1977 | Crankshaw et al. | 156/363 X |

*Primary Examiner*—David A. Simmons

*Attorney, Agent, or Firm*—Gordon L. Peterson

[57] ABSTRACT

The velocity compensator disclosed herein measures the velocity of an article being moved toward an apparatus which is to perform a work operation on the article. The velocity compensator then provides an actuation signal to the apparatus at an appropriate instant so that the actuator will have sufficient time to perform the work operation on the article as it is moved along.

15 Claims, 2 Drawing Figures

Fig. 1
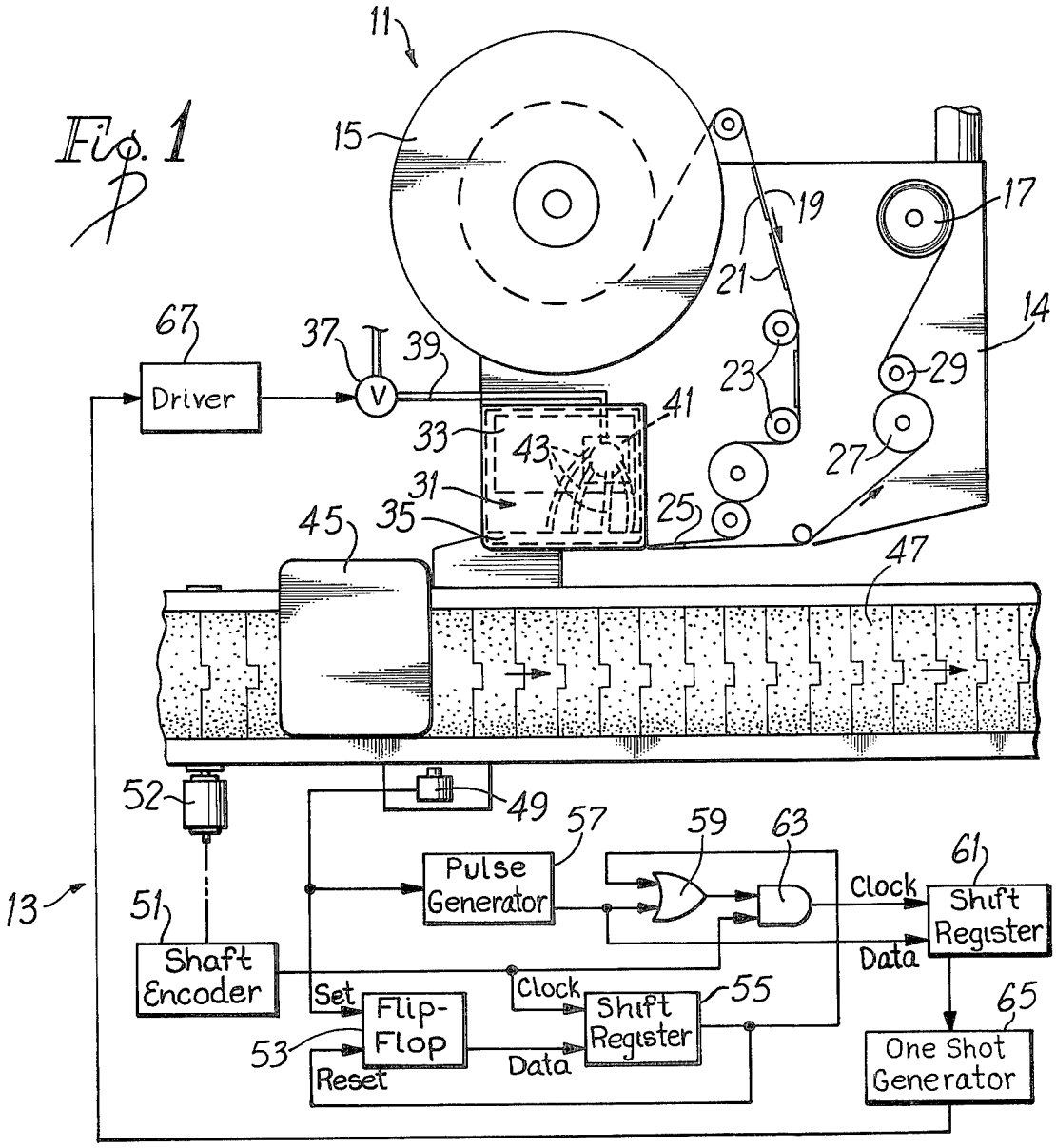
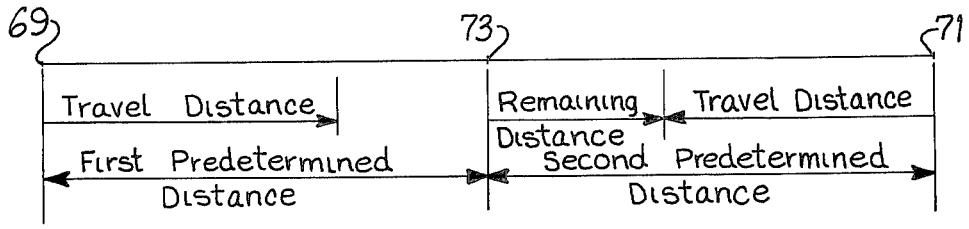
Fig. 2

VELOCITY COMPENSATOR AND APPARATUS INCORPORATING THE SAME

BACKGROUND OF THE INVENTION

Various production processes require that a work operation be performed on articles as they are moved through a work station. Because the articles are moving and because of inherent electrical and mechanical delays, the actuation signal which commands the apparatus to perform the work operation must be given before the article reaches the work station. This lead time assures that the work operation will be performed when the article is at the work station.

One example of a process where these factors are applicable is label application. In label application, articles to be labeled are continuously conveyed past a label applicator. The label applicator applies a label to each of the articles as the article is moved through a labeling station. Although different arrangements are possible, typically, the label applicator releasably retains a label at a first location. When the article to be labeled nears the labeling station, an actuation signal is provided commanding that the label applicator immediately transfer the label from the first location to the article. In this specific example, the actuation period is the period of time from the actuation signal until the adhesive face of the label contacts the article.

One problem which occurs in processes of this kind is that line speed, i.e., the speed of article movement, is a variable. Thus, prior art systems that provide the actuation signal a fixed distance from the work station introduce the risk that the work operation will not be performed on the article at all, or if it is, it will be performed at the wrong location. For example, in the case of label application, the label may be applied to the wrong location on the article or it may miss the article entirely.

This problem can be overcome with a velocity compensator. Prior art velocity compensators are generally complicated and very expensive. Moreover, analog prior art systems are subject to drift.

SUMMARY OF THE INVENTION

This invention provides a single, inexpensive velocity compensator. The velocity compensator of this invention can be used with many different apparatuses which perform work operations on articles moved past the apparatus. For example, the velocity compensator can be used with a label applicator, a glue applicator, an ejector for removing an article from the line, etc.

The actuation period for a given apparatus is normally substantially constant for any given work operation. The invention uses this to advantage by measuring the distance which the article travels during the actuation period. This travel distance equals the distance upstream of the work station where the actuation signal should be given.

Although article location relative to the work station is known at the cycle initiation location, i.e., the location at which the above-mentioned measurement of the travel distance is initiated, article location is unknown at the completion of this measurement. However, with this invention, article location immediately following this measurement need not be known.

The article is again located when it reaches a secondary initiation location. The secondary initiation location is spaced a first predetermined distance downstream of the cycle initiation location so that ample time is provided for the measurement of the travel distance. The secondary initiation location is spaced a second predetermined distance upstream of the work station.

Measuring means is provided for measuring distances having lengths equal to the second predetermined distance referred to above. The measuring means reduces the second predetermined distance by the travel distance to thereby define a remaining distance. The measuring means is responsive to the article reaching the secondary initiation location to provide an actuation signal after the article has moved the remaining distance. This assures that the actuation signal will be provided at a distance equal to the travel distance upstream from the work station.

The invention is based on the assumption that article velocity will not be materially varied after the travel distance is measured. This is a safe and realistic assumption because the travel distance is itself an average of instantaneous variations in line speed. Furthermore, by having the cycle initiation location close to the work station, there is little opportunity for major line speed changes prior to completion of the work operation. For example, the cycle initiation location may be only 4 inches from the work station. The travel distance should not exceed the second predetermined distance and the latter should be no greater than the first predetermined distance.

These concepts can be advantageously implemented in a digital electronic circuit. For example, a pulse generator can be used to provide a pulse having a width or duration corresponding to the actuation period. The duration of the pulse can be varied so that the same velocity compensator can be used with different apparatuses. When the article reaches the cycle initiation location, the pulse generator can be initiated by a conventional article detector, such as a photocell or a switch. A shaft encoder or other device for generating pulses representing an incremental distance of article travel can be utilized to provide data relating to article speed.

The measuring means can advantageously include a shift register. By applying the pulse from the pulse generator to the data input of the shift register and clocking the shift register with the pulses from the shaft encoder, data corresponding to velocity times time or distance is fed directly into the shift register. The shift register has a bit capacity corresponding to the second predetermined distance. Accordingly, by again initiating the clocking of the shift register when the article reaches the secondary initiation location and by clocking the shift register at a rate related to the speed of movement of the article, the first bit of data is clocked out of the shift register when the article is upstream of the work station by a distance equal to the travel distance. This simple and inexpensive implementation gives very accurate results.

The invention, together with further features and advantages thereof, may best be understood by reference to the following description taken in connection with the accompanying illustrative drawing.

BRIEF DESCRIPTION OF THE DRAWING

FIG. 1 is a partially schematic plan view of a label applicator having a velocity compensator constructed in accordance with this invention incorporated therein.

FIG. 2 is a diagram illustrating the operation of the velocity compensator.

DESCRIPTION OF THE PREFERRED EMBODIMENT

FIG. 1 shows a label applicator 11 having a velocity compensator 13 incorporated therein. The label applicator 11 is merely illustrative of the kind of apparatus or actuator with which the velocity compensator 13 can be utilized.

The label applicator 11 can be of various different constructions. For example, the label applicator 11 may be of the construction shown and described in U.S. Pat. No. 3,885,705.

In the embodiment illustrated, the label applicator 11 includes a supporting structure 14, a supply reel 15, and a take-up reel 17. Both of the reels 15 and 17 are rotatably mounted on the supporting structure 14. A backing strip or carrier strip 19 is wound on the supply reel 15, and a plurality of labels 21 are adhesively secured to and carried by the backing strip. The backing strip 19 extends from the supply reel 15 over guide rollers 23 mounted on the supporting structure 14, over a peeling bar 25, and between a drive roller 27 and an idler roller 29 to the take-up reel 17.

The label applicator 11 also includes a housing or vacuum box 31 defining a chamber 33. The housing 31 includes a pervious wall section in the form of a grid 35, one end of which lies closely adjacent the peeling bar 25. The chamber 33 is evacuated to a pressure less than atmospheric so that a suction force is applied through the grid 35. Air under greater than atmospheric pressure is supplied from a source (not shown) through the controllable automatic valve 37, which may be a solenoid valve, and a conduit 39 to a manifold 41. From the manifold 41, the air is transmitted through a plurality of flexible tubes 43 to the grid. Thus, by opening the valve 37, a blast of air under pressure is supplied to the grid 35.

In use, the drive roller 27 is driven intermittently and for predetermined periods to draw the backing strip 19 across the peeling bar 25. This causes the peeling bar 25 to function in a conventional manner to remove the labels 21 and supply them in sequence to the grid 35. As shown in FIG. 1, a label 21' has been removed from the backing strip 19 and supplied to the grid 35. The label 21' is releasably retained on the grid 35 by the vacuum pressure within the chamber 33.

When it is desired to transfer the label 21' to an article 45, an actuation signal is provided by the velocity compensator 13 to the valve 37 to cause the valve to momentarily open. This provides a blast of air under pressure to the grid 35 of sufficient force to remove the label 21' from the grid and transfer it to the article 45. The label 21' is retained on the article 45 by the adhesive carried on one face of the label.

Some measurable time is required from the initiation of the actuation signal until the label 21' contacts the article 45. This is the actuation period for the label applicator 11, and it includes all of the electrical, mechanical and other delays inherent in opening the valve 37 permitting the air pressure to rise sufficiently at the discharge ends of the tubes 43 at the grid 35 to remove the label 21', and the time required for the label to travel the distance between the grid 35 and the adjacent surface of the article 45.

The article 45, as well as other articles (not shown) are moved via a conveyor 47 through a labeling station at which the article 45 receives the label 21'. The conveyor 47 moves continuously; however, as is often the case, conveyor speed may vary.

The primary function of the velocity compensator 13 is to provide the actuation signal when the article 45 is sufficiently upstream of the labeling station so that the label 21' will be applied precisely to the desired location on the article. The velocity compensator 13 includes a sensor or detector 49 which, in the embodiment illustrated, is mounted on the supporting structure 14 closely adjacent the labeling station The detector 49 may be any device which is capable of providing a detection signal when a suitable reference location on the article 45, such as the leading edge of the article 45, reaches a known position referred to herein as a cycle initiation location. For example, the detector 49 may be a photocell, switch, a pneumatically operated detector, etc. In the embodiment illustrated, the detector 49 is a photocell detector.

Data concerning the speed of movement of the article 45 can be obtained in different ways. In the embodiment illustrated, a shaft encoder 51 in the form of an optical encoder is driven by a motor 52 which drives the conveyor 47. The shaft encoder 51 provides a velocity signal in the form of pulses with each of the pulses representing an incremental distance of conveyor 47 and article 45 movement.

The detection signal from the detector 49 is transmitted to the seat terminal of a set/reset flip-flop 53 to set the flip-flop to its high or "1" state. The output from the flip-flop 53 is provided to the data terminal of a shift register 55, which in the embodiment illustrated, is a serial in, serial out shift register. The velocity signal from the shaft encoder 51 is applied to the clock terminal of the shift register 55. Accordingly, the signal from the flip-flop 53 is loaded into the shift register 55 at a clock rate established by the speed of movement of the article 45.

The detection signal is also applied to a pulse generator 57 which may be a one-shot pulse generator. In response to the detection signal, the pulse generator 57 provides a single pulse having a predetermined, but adjustable, pulse width or duration. The pulse width or pulse duration can be manually adjusted to equal the actuation period of the label applicator 11. Thus, the single pulse output of the pulse generator 57 can be considered a timing signal.

The timing signal from the pulse generator 57 is applied to one input of an OR gate 59 and to the data terminal of a shift register 61, which may be identical to the shift register 55. The output of the OR gate 59 is applied to one input of an AND gate 63 and the other input of the AND gate 63 is coupled to receive the velocity signal from the shaft encoder 51. Accordingly, the AND gate is immediately enabled and its output, which is the velocity signal from the shaft encoder 51, is applied to the clock terminal of the shift register 61. This loads the timing signal from the pulse generator 57 into the shift register 61 at a rate established by the velocity signal from the shaft encoder 51. In other words, data is loaded into the shift register 61 for a period of time equal to the actuation period and at a rate which is proportional to the speed of movement of the article 45.

After a period corresponding to the actuation period, the timing signal from the pulse generator 57 terminates, the AND gate 63 is inhibited and data is no longer shifted in the shift register 61. The bit capacity of the shift register 61 is selected so that its capacity is not fully taken before the end of the timing signal from the pulse generator 57.

Data continues to be clocked into the shift register 55 following termination of the timing signal from the pulse generator 57. Ultimately however, the data initially loaded into the shift register 55 is shifted to its output to provide a secondary initiation signal which is transmitted to the reset terminal of the flip-flop 53 to reset the flip-flop to its low or zero state. Accordingly, thereafter zeros are loaded into the shift register 55 at the clock rate established by the velocity signal from the shaft encoder 51.

In addition, the secondary initiation signal is transmitted to the other input of the OR gate 59 to enable this gate. The output of the OR gate 59 again enables the AND gate 63 so thereafter the data in the shift register 61 can be clocked through the shift register by the velocity signal from the shaft encoder 51. After a length of time which is a function of the unused bit capacity of the shift register 61 and the velocity signal from the shaft encoder 51, the data first loaded into the shift register 61 is provided at the output of the shift register 61 to provide an actuation signal. The actuation signal can be processed in any suitable manner so that it can be used to open the valve. For example, in the embodiment illustrated, the output form the shift register 61 actuates a one-shot generator 65 which in turn operates a driver 67 which provides the actuation signal in usable form to the valve 37 to momentarily open the valve.

The operation of the velocity compensator 13 can best be understood by reference to FIG. 2. The detector 49 detects the article 45 and provides the detection signal at a cycle initiation location 69 which is spaced a known distance from a work station 71 with such distance being represented by the line between these two locations. The work station 71 is the location of the leading edge of the article 45 when the label 21' first contacts the article 45. If the compensator keys off of a reference location on the article 45 other than the leading edge, such as the trailing edge, then the work station 71 is the location of such reference when the label 21' first contacts the article 45. A secondary initiation location 73 lies at a known position intermediate the cycle initiation location 69 and the work station 71. The secondary initiation location 73 is the location of the article 45 when the secondary initiation signal is provided by the shift register 55 to the shift register 61 to restart the clocking of the shift register 61. The location 73 is spaced from the location 69 by a first predetermined distance, and the location 73 is spaced from the work station 71 by a second predetermined distance. The first predetermined distance in the embodiment illustrated corresponds to the bit capacity of the shift register 55 and the second predetermined distance corresponds to the bit capacity of the shift register 61. The primary function of the shift register 55 is to measure the first predetermined distance and thus to establish the location of the secondary initiation location 73. Of course, the location of the secondary initiation location 73 could be accomplished in other ways, such as by the use of a detector or sensor at the secondary initiation location 73.

For optimum utilization of shift register capacity, the first and second predetermined distances should be equal. In this event, the shift registers 55 and 61 may be identical.

In use, when the article 45 reaches the cycle initiation location 69, the detector 49 responds by providing the detection signal to the pulse generator 57 and to the flip-flop 53. The output from the flip-flop 53 is loaded into the shift register 55 by the velocity signal from the shaft encoder 51 as descirbed above so that the shift register 55 immediately begins tracking the article 45 along the first predetermined distance. Simultaneously, the pulse generator 57 provides the timing signal to the shift register 61 so that this data is loaded into the shift register 61 as described above at the clock rate established by the velocity signal from the shaft encoder 51. Because the clock rate is a function of article velocity and the timing signal has a duration equal to the actuation period, the information loaded into the shift register 61 is velocity of the article 45 times time where time is the actuation period. Because velocity times time equals distance, a distance corresponding to the distance that the article 45 travels during the actuation period, i.e., the travel distance, is loaded into the shift register 61. The travel distance uses up portions of the first and second predetermined distances as shown in FIG. 2, but it is not greater than either of the predetermined distances.

After the travel distance is loaded into the shift register 61, the OR gate 59 and the AND gate 63 are inhibited whereupon shifting of the data in the shift register 61 terminates. At this point, the shift register 61 has an unused portion or remaining capacity which corresponds to a remaining distance as shown in FIG. 2.

The data from the flip-flop 53 continues to be shifted through the shift register 55 at the clock rate established by the velocity signal from the shaft encoder 51. Thus, the shift register 55 tracks the article 45 from the cycle initiation location 69 to the secondary initiation location 73 at which time the shift register 55 provides a signal to the OR gate 59, the output from which enables the AND gate 63 whereupon the data in the shift register 61 is shifted toward its output of the register at the clock rate established by the velocity signal from the shaft encoder 51.

After the article 45 has moved the remaining distance from the secondary initiation location 73, the first bit of data in the shift register 61 is shifted to its output to form the actuation signal which momentarily opens the valve 37. As shown in FIG. 2, upon movement of the remaining distance, the leading edge of the article 45 is spaced the travel distance from the work station which is, by definition, the distance that the article will travel during the actuation period. This assures that the article 45 will be at the correct location when the label 21' contacts the selected portion of its surface. After the valve 37 is open, the label applicator 11 automatically indexes another label 21 to the grid 35 in a well-known conventional manner. When the next article 45 reaches the cycle initiation location 69, the operation described above is repeated. If the shift registers 55 and 61 have identical bit capacities, they are ready to be used in connection with the next article 45 so long as the space between articles to be labeled is equal to or greater than the distance between the cycle initiation location 69 and the work station 71.

Although an exemplary embodiment of the invention has been shown and described, many changes, modifications and substitutions may be made by one having ordinary skill in the art without necessarily departing from the spirit and scope of this invention.

I claim:

1. A velocity compensator for controlling the initiation of an actuator wherein an article is moved along a path through a work station and actuator performs a work operation on the article at the work station with the actuator requiring an actuation period from the time it is initiated to perform the work operation, said compensator comprising:

first means responsive to movement of the article upstream of the work station for providing a distance signal having a characteristic related to a travel distance which is the distance the article travels in a period equal to the actuation period, said travel distance being no greater than a first predetermined distance;

measuring means for measuring distances having lengths up to a second predetermined distance, said second predetermined distance being at least as great as the travel distance;

said measuring means including means responsive to said distance signal for reducing said second predetermined distance by said travel distance to define a remaining distance whereby the measuring means is then capable of measuring a distance equal to said remaining distance;

second means responsive to the article reaching a first location which is approximately said second predetermined distance from the work station for providing a first signal to the measuring means; and said measuring means including means responsive to the article traveling a distace equal to said remaining distance after the occurrence of said first signal to provide an actuation signal which can be used to initiate the actuator.

2. A velocity compensator as defined in claim 1 wherein said first means includes a pulse generator for providing a pulse having a width corresponding to the actuation period and means responsive to the rate of article movement for providing a digital signal for the duration of said pulse whereby said digital signal constitutes said distance signal.

3. A velocity compensator as defined in claim 1 wherein said measuring means includes a shift register having a bit capacity corresponding to said second predetermined distance and said distance signal is a digital signal having a number of bits which correspond to the travel distance.

4. A velocity compensator as defined in claim 1 including detector means for providing a signal when the article arrives at a cycle initiation location upstream of the work station, said cycle initiation location being said first predetermined distance from said first location, and said first means being responsive to said detection signal.

5. A velocity compensator as defined in claim 4 wherein said first means includes a pulse generator for providing a pulse having a width corresponding to the actuation period and means responsive to the rate of article movement for providing a digital signal for the duration of said pulse whereby said digital signal constitutes said distnace signal, and said measuring means includes a shift register having a bit capacity corresponding to said second predetermined distance and said distance signal has a number of bits corresponding to the travel distance.

6. A velocity compensator for controlling the initiation of an acutator wherein an article is moved along a path through a work station and the actuator performs a work operation on the article at the work station, said compensator comprising:

detection means for providing a detection signal when an article arrives at a cycle initiation location upstream of the work station;

first means responsive to the detection signal for measuring the distance the article travels during a predetermined period, said distance being a travel distance, said travel distance being less than a first predetermined distance;

second means responsive to the article reaching a secondary initiation location which is said first predetermined distance from said cycle initiation location for providing a first signal; and measuring means responsive to said first signal and movement of the article for providing an actuation signal after the article has traveled from said secondary initiation location a distance equal to a second predetermined distance less said travel distance, said actuation signal being usable to initiate the actuator.

7. A velocity compensator as defined in claim 6 wherein said second predetermined distance is equal to or less than said first predetermined distance and said travel distance is no greater than said second predetermined distance.

8. An apparatus for performing a work operation on an article as the article is moved along a path through a work station, said apparatus comprising:

means responsive to an actuation signal for performing a work operation on the article and having an actuation period extending from the time of said actuation signal to the completion of the work operation, said work operation being completed at said work station;

first means responsive to movement of the article upstream of the work station for providing a distance signal having a characteristic related to a travel distance which is the distance the article travels in a period equal to the actuation period, said travel distance being no greater than a first predetermined distance;

measuring means for measuring distances having lengths up to a second predetermined distance, said second predetermined distance being at least as great as the travel distance;

said measuring means including means responsive to said distance signal for reducing said second predetermined distance by said travel distance to define a remaining distance whereby the measuring means is then capable of measuring a distance equal to said remaining distance;

second means responsive to the article reaching a first location which is approximately said second predetermined distance from the work station for providing a first signal to the measuring means; and said measuring means including means responsive to the article traveling a distance equal to said remaining distance after the occurrence of said first signal to provide an actuation signal which can be used to initiate the actuator.

9. An apparatus as defined in claim 8 wherein said performing means includes means for applying a label to the article.

10. An apparatus as defined in claim 9 wherein said label applying means includes means for releasably retaining the label and means responsive to the actuation signal for transferring said label from said retaining means to the article, said actuation period being measured from the occurrence of the actuation signal until the label contacts the article.

11. An apparatus as defined in claim 10 wherein said first means includes a pulse generator for providing a pulse having a width corresponding to the actuation period and means responsive to the rate of article movement for providing a digital signal for the duration of said pulse whereby said digital signal constitutes said distance signal.

12. An apparatus as defined in claim 10 wherein said measuring means includes a shift register having a bit capacity corresponding to said second predetermined distance and said distance signal is a digital signal having a number of bits which correspond to the travel distance.

13. An apparatus as defined in claim 10 including detector means for providing a signal when the article arrives at a cycle initiation location upstream of the work station, said cycle initiation location being said first predetermined distance from said first location, and said first means being responsive to said detection signal.

14. An apparatus as defined in claim 10 wherein said first means includes a pulse generator for providing a pulse having a width corresponding to the actuation period and means responsive to the rate of article movement for providing a digital signal for the duration of said pulse whereby said digital signal constitutes said distance signal, and said measuring means includes a shift register having a bit capacity corresponding to said second predetermined distance and said distance signal has a number of bits corresponding to the travel distance.

15. A velocity compensator as defined in claim 6 wherein said first means includes means for adjusting said predetermined period.

* * * * *